US007543523B2

(12) United States Patent
Hunn

(10) Patent No.: US 7,543,523 B2
(45) Date of Patent: Jun. 9, 2009

(54) ANTIBALLISTIC ARMOR

(75) Inventor: David L. Hunn, Kennedale, TX (US)

(73) Assignee: Lockheed Martin Corporation, Grand Prairie, TX (US)

( * ) Notice: Subject to any disclaimer, the term of this patent is extended or adjusted under 35 U.S.C. 154(b) by 1586 days.

(21) Appl. No.: 09/968,417

(22) Filed: Oct. 1, 2001

(65) Prior Publication Data

US 2009/0114082 A1 May 7, 2009

(51) Int. Cl.
*F41H 5/04* (2006.01)

(52) U.S. Cl. ..... 89/36.02

(58) Field of Classification Search ..... 89/36.02
See application file for complete search history.

(56) References Cited

U.S. PATENT DOCUMENTS

| | | | | |
|---|---|---|---|---|
| 3,324,768 | A | 6/1967 | Eichelberger | 89/36 |
| 3,431,818 | A | 3/1969 | King | 89/36 |
| 3,705,558 | A | 12/1972 | McDougal et al. | 109/84 |
| 3,711,363 | A * | 1/1973 | Jerema | 428/613 |
| 4,061,815 | A | 12/1977 | Poole, Jr. | 428/215 |
| 4,099,961 | A * | 7/1978 | Patten | 75/415 |
| 4,179,979 | A | 12/1979 | Cook et al. | 89/36 A |
| 5,025,707 | A * | 6/1991 | Gonzalez | 89/36.17 |
| 5,361,678 | A | 11/1994 | Roopchand et al. | 89/36.02 |
| 5,364,679 | A | 11/1994 | Groves | 428/76 |
| 5,376,426 | A | 12/1994 | Harpell et al. | 428/109 |
| 5,723,807 | A * | 3/1998 | Kuhn, II | 89/36.02 |
| 5,824,940 | A | 10/1998 | Chediak et al. | 89/36.05 |
| 5,924,694 | A * | 7/1999 | Kent | 273/408 |
| 5,972,819 | A | 10/1999 | Cohen | 501/127 |
| 6,112,635 | A | 9/2000 | Cohen | 89/36.02 |
| 6,203,908 | B1 | 3/2001 | Cohen | 428/397 |
| 6,298,765 | B1 * | 10/2001 | Dvorak | 89/36.02 |
| 6,357,332 | B1 * | 3/2002 | Vecchio | 89/36.02 |
| 6,408,734 | B1 | 6/2002 | Cohen | 89/36.02 |
| 6,418,832 | B1 * | 7/2002 | Colvin | 89/36.02 |

(Continued)

FOREIGN PATENT DOCUMENTS

EP 0699887 A2 3/1996

(Continued)

OTHER PUBLICATIONS

PCT/US00/06220, Sep. 2000, Yu.*

(Continued)

*Primary Examiner*—Troy Chambers
(74) *Attorney, Agent, or Firm*—Daren C. Davis; James E. Walton

(57) ABSTRACT

An antiballistic armor includes a core having a first surface, a second surface, and pockets extending into the core. The antiballistic armor further includes projectile impeding elements, wherein one of the projectile impeding elements is disposed within each of the pockets of the core. Further, the antiballistic armor includes a first face sheet joined to the first surface of the core and a second face sheet joined to the second surface of the core. A method includes producing pockets in a core that extend into the core, attaching projectile impeding elements within the pockets in the core, joining a first face sheet onto the first surface of the core, and joining a second face sheet onto a second surface of the core.

22 Claims, 3 Drawing Sheets

U.S. PATENT DOCUMENTS

2002/0178900 A1* 12/2002 Ghiorse
2003/0057101 A1* 3/2003 Ward

FOREIGN PATENT DOCUMENTS

EP 0 843 149 A1 5/1998

OTHER PUBLICATIONS

"Armor for Light Combat Vehicles" by R. M. Ogorkiewicz; *Janes International Defense Review*, Jul. 2002 pp. 41-45.

"Modeling of the Ballistic Behavior of Gradient Design Composite Armors" by J. Jovicic, A. Zavaliangos, F. Ko; *Composites Part A: Applied Science and Manufacturing*, vol. 31 Issue 8 (2000) pp. 773-784.

"Development of a Versatile, Low Cost Ceramic Armor (U)" by C. James Shih, Marc A. Adams, Gene A. Howald; 11th Annual US Army Ground Vehicle Survivability Symposium, held by The National Defense Industrial Association; Mar. 27-30, 2002, 11 pages.

European Search Report dated Jan. 10, 2003 for Application No. 02256414.0 filed Sep. 13, 2002.

* cited by examiner

ANTIBALLISTIC ARMOR

BACKGROUND OF THE INVENTION

1. Field of the Invention

This invention relates to a method and apparatus for reducing the effectiveness of a ballistic projectile on an object.

2. Description of the Related Art

In combat situations, it is desirable to protect vehicles, such as tanks, personnel carriers, or the like from armor-piercing projectiles as well as from small arms fire. Accordingly, these types of vehicles are known to have armor to reduce the likelihood that such rounds will penetrate the vehicle. If the rounds penetrate the vehicle, the occupants of the vehicle may be injured or the vehicle's ability to operate may be impaired. It may also be desirable for the armor to be able to survive multiple rounds striking the armor in close proximity to one another, so that the integrity of the vehicle is not compromised.

While protecting the vehicle and its occupants is generally of primary importance, other factors may play a role in the design of armor for the vehicle. It is typically desirable for the vehicle to be as lightweight as possible. Generally, fuel consumption by the vehicle increases as its weight increases. A heavier vehicle usually requires a heavier drive train than a lighter vehicle, which further increases weight. Increased weight may also reduce the mobility of the vehicle and, thus, reduce the utility of the vehicle in combat. As the weight of the vehicle's armor contributes to the overall weight of the vehicle, it is often desirable for the vehicle's armor to be as lightweight as possible. Many known armor systems, while protecting the vehicle from ballistic damage, add significant weight to the vehicle and provide little or no additional structural strength to the vehicle.

It is also generally not desirable for the vehicle's armor to greatly increase the overall size of the vehicle (e.g., the vehicle's height, width, length, volume, and the like). It may be desirable for existing transportation equipment (e.g., trucks, trailers, aircraft, and the like) to be capable of transporting the vehicle. If the size of the vehicle is increased over previous vehicles, the existing transportation equipment may not be capable of transporting the vehicle, or the existing transportation equipment may be limited to carrying fewer vehicles per load. The overall size of the vehicle may also be a factor in combat situations. Generally, smaller targets (i.e., smaller vehicles) are more difficult to hit with artillery, such as rockets, mortars, missiles, and the like. Thus, it may be desirable for the vehicle's overall size to be smaller, rather than larger, to reduce the likelihood of an artillery hit.

It is also generally desirable that the vehicle's armor be durable. During combat and during travel between combat locations, the vehicle may encounter flying rocks, debris, shrapnel, and the like. If the armor is overly thin or brittle, it may not be capable of surviving impacts from such sources.

Cost may also be a consideration in vehicle armor. Armor that uses exotic materials (e.g., laminated ceramics of boron carbide, silicon carbide, and alumina; fiberglass/epoxy laminates; fiberglass/phenolic laminates; and the like), or armor that has many components in difficult-to-produce configurations, may be quite effective in combat but may be unaffordable.

The present invention is directed to overcoming, or at least reducing, the effects of one or more of the problems set forth above.

SUMMARY OF THE INVENTION

In one aspect of the present invention, an antiballistic armor is provided. The antiballistic armor includes a core having a first surface, a second surface, and defining a plurality of pockets extending into the core. Further, the antiballistic armor includes a plurality of projectile impeding elements, wherein one of the projectile impeding elements is disposed within each of the pockets of the core. Yet further, the antiballistic armor includes a first face sheet joined to the first surface of the core, and a second face sheet joined to the second surface of the core.

In another aspect of the present invention, a method is presented. The method includes producing pockets in a core, attaching projectile impeding elements within the pockets in the core, joining a first face sheet onto the first surface of the core, and joining a second face sheet onto a second surface of the core.

In yet another aspect of the present invention, an antiballistic armor is presented. The antiballistic armor includes a core having a first surface, a second surface, and a layer of projectile impeding elements dispersed therein. The antiballistic armor further includes a first face sheet joined to the first surface of the core and a second face sheet joined to the second surface of the core.

BRIEF DESCRIPTION OF THE DRAWINGS

The invention may be understood by reference to the following description taken in conjunction with the accompanying drawings, in which the leftmost significant digit(s) in the reference numerals denote(s) the first figure in which the respective reference numerals appear, and in which.

Figure 1:
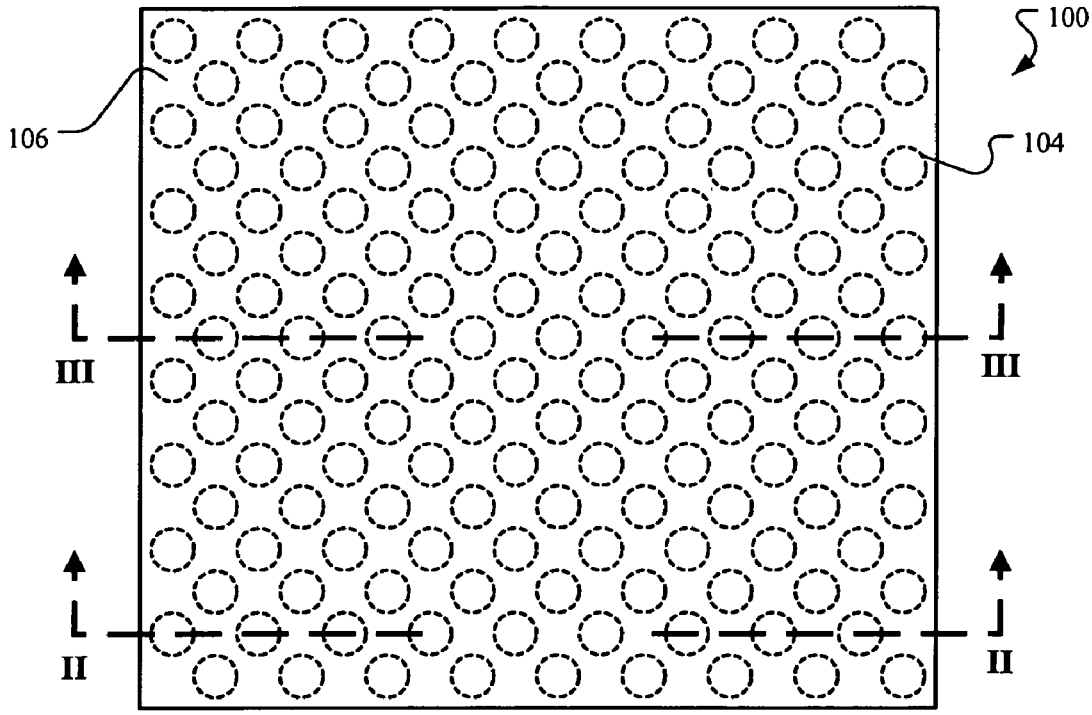
FIG. 1 is a top view of an antiballistic armor according to one embodiment of the present invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF SPECIFIC EMBODIMENTS

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort, even if complex and time-consuming, would be a routine undertaking for those of ordinary skill in the art having the benefit of this disclosure.

Figure 2:
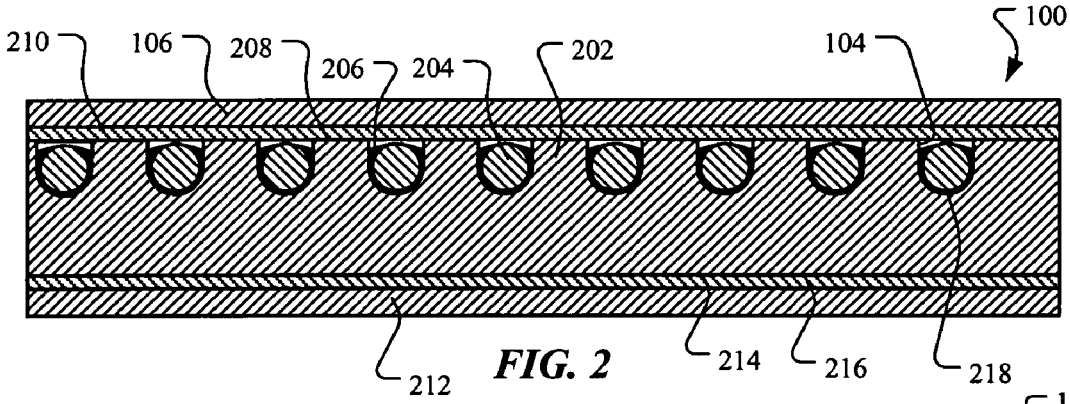
FIG. 2 is a cross sectional view of the antiballistic armor of FIG. 1 taken along the line II-II.
Figure 3:
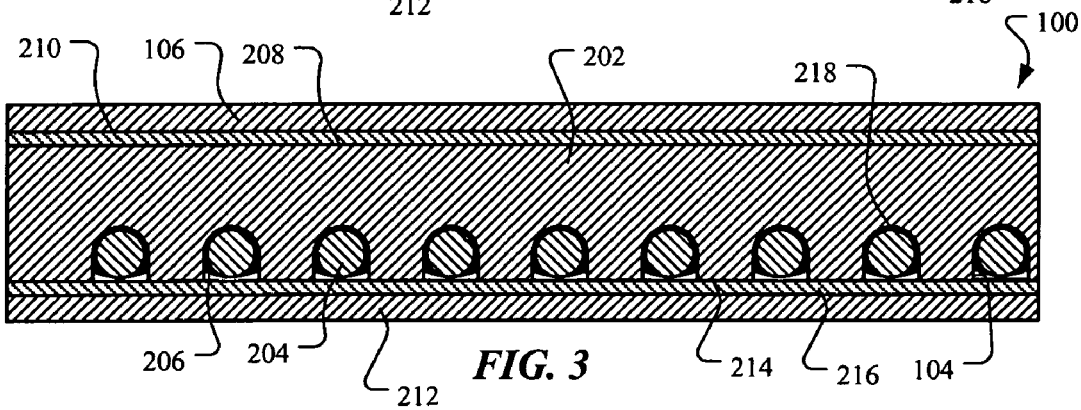
FIG. 3 is a cross sectional view of the antiballistic armor or FIG. 1 taken along the line III-III.

FIGS. 1-3 illustrate an antiballistic armor 100 according to the present invention. The antiballistic armor 100 includes a core 202, shown in FIG. 2 and in FIG. 3. The antiballistic armor 100 also includes a plurality of balls 204 (only one indicated in each of FIGS. 2 and 3) held in a plurality of respective pockets 104 (only one indicated in each figure) that extend into the core 202. In one embodiment, the balls 204 are held in the pockets 104 by a layer 206 of a bonding material. An upper face sheet 106 is joined to a front surface 208 of the core 202 via a layer 210 of a bonding material and a lower face sheet 212 is joined to a back surface 214 of the core 202 by a layer 216 of a bonding material. The upper face sheet 106 and the lower face sheet 212 may be joined to the core 202 by any desired method, e.g., adhesive bonding, brazing, diffusion bonding, welding, or the like.

The core 202 may be made from a foamed metallic material as desired, e.g., a foamed iron alloy, a foamed nickel or nickel alloy, a foamed aluminum or aluminum alloy, a foamed titanium or titanium alloy, or the like. The core 202 may be made of either an open-celled foamed metallic material or a closed-cell foamed metallic material. In one embodiment, the core 202 is made of a foamed metallic material having about four pores per linear centimeter to about 16 pores per linear centimeter. In another embodiment, the core 202 is made of a foamed metallic material having a continuously connected, open-celled (reticulated) geometry and having a duodecahedronal cell shape, such as Duocel™ foam, manufactured by ERG Materials and Aerospace Corporation of Oakland, Calif. In another embodiment, the core 202 is made of metallic foam, manufactured by Porvair Fuel Cell Technology of Hendersonville, N.C. Such foamed metallic materials are generally lightweight, have sufficient mechanical properties for certain structural applications, and are generally reasonable in cost.

In one embodiment, the pockets 104 are arranged such that the pockets 104 extending into the core 202 from the front surface 208 are staggered relative to the pockets 104 extending into the core 202 from the back surface 214. Thus, in this embodiment, the pockets 104 extending into the core 202 from the front surface 208 are not directly above the pockets 104 extending into the core 202 from the back surface 214. While the pockets 104 are shown to be of similar size and evenly spaced apart, they can be of any size and in any desired arrangement to accommodate any desired size and arrangement of the balls 204. Sizes and separations may be mixed and matched, if desired. Further, each of pockets 104 is shown to have a bottom portion 218 (only one indicated in each of FIGS. 2 and 3) that is rounded or radiused; however, it is within the scope of the present invention for the pockets 104 to have any desired shape. For example, one or more of the pockets 104 may have bottom portions 218 that are conical, square-bottomed, or the like.

The balls 204 may be made of a high compressive strength, high hardness, low ductility material, e.g., silicon nitride, silicon carbide, boron nitride, aluminum oxide, or the like. In one embodiment, the balls 204 are commercial-grade silicon nitride balls, such as those made from Ceralloy®, manufactured by Ceradyne of Los Angeles, Calif. Generally, the balls 204 may be of any desired diameter; however, it is generally desirable for the balls 204 to have diameters within a range of about six mm to about 25 mm. In one embodiment, the balls 204 have a diameter of about 16 mm. The antiballistic armor 100 may include balls 204 that all have generally the same diameter or may include balls 204 that have different or varying diameters. While it may be convenient to incorporate balls 204 that are generally spherical into the antiballistic armor 100, the present invention encompasses projectile impeding elements (e.g., the balls 204 or the like) of any desired shape.

As indicated above, the embodiment illustrated in FIGS. 1-3 includes the layers 206 of a bonding material that is used to hold the balls 204 in the pockets 104 of the core 202. The bonding material may be an adhesive (e.g., an epoxy-based adhesive, a silicone-based adhesive, or the like), a brazing material (e.g., a brazing paste or the like), or a soldering material (e.g., a soldering paste or the like). Although FIGS. 1-3 show the balls 204 and the layers 206 of bonding material only partially filling the pockets 104 in the core 202, the present invention encompasses the pockets 104 being filled with the balls 204 and the layers 206 of bonding material. Alternatively, the antiballistic armor 100 may omit the layers 206. In such an embodiment, the pockets 104 are sized such that the balls 204 may be held within the pockets 104 by friction between the balls 204 and the pockets 104.

The upper face sheet 106 may be made of any material that is capable of providing environmental protection to the interior of the antiballistic armor 100 (e.g., the core 202, the balls 204, and the like), structural strength to the antiballistic armor 100, and/or properties to begin defeating an incoming projectile or round. In one embodiment, the upper face sheet 106 is made of titanium or a titanium alloy and has a thickness of about six mm. As indicated above, the upper face sheet 106 is joined to the front surface 208 of the core 202 by the layer 210 of a bonding material. The bonding material may be an adhesive (e.g., an epoxy-based adhesive, a silicone-based adhesive, or the like), a brazing material (e.g., a brazing paste, a sheet of brazing material, or the like), or a soldering material (e.g., a soldering paste, a sheet of soldering material, or the like).

The lower face sheet 212 may be made of any material that is capable of providing environmental protection to the interior of the antiballistic armor 100, structural strength to the antiballistic armor 100, and/or properties to retain fragments resulting from the projectile or round impacting the antiballistic armor 100, e.g., a metallic material or composite laminate. In one embodiment, the lower face sheet 212 is made of titanium or a titanium alloy and has a thickness of about six mm. As indicated above, the lower face sheet 212 is joined to the back surface 214 of the core 202 by the layer 216 of a bonding material. The bonding material may be an adhesive (e.g., an epoxy-based adhesive, a silicone-based adhesive, or the like), a brazing material (e.g., a brazing paste, a sheet of brazing material, or the like), or a soldering material (e.g., a soldering paste, a sheet of soldering material, or the like). The layer 216 of a bonding material may be made of the same material as or different material than the layer 210 of a bonding material. In one embodiment, the bonding material used in the layers 206 may be used to join the face sheets 106, 212 to the core 202.

The antiballistic armor 100 provides a level of protection to a vehicle or the like (not shown) by inhibiting a projectile or round (not shown) fired toward the vehicle from entering the vehicle. The upper face sheet 106 serves as an initial component in defeating the projectile or round by blunting and decreasing the velocity of the incoming projectile or round. Upon penetration of upper face sheet 106, the projectile or round strikes one or more of the balls 204, thus causing the projectile or round to shatter and/or tumble. Contact of the projectile or round with the balls 204 further decreases the velocity of the projectile or round. The lower face sheet 212 inhibits debris resulting from the impact event from passing therethrough and entering the vehicle.

The antiballistic armor 100 may be applied to one or more exterior surfaces of an object (e.g., a vehicle or the like). Note that the antiballistic armor 100 is not limited to use with vehicles. The antiballistic armor 100 may be used to armor virtually any object one desires to protect from a ballistic projectile. Alternatively, the antiballistic armor 100 may be integrated into the object's structure, such that the antiballistic armor 100 is used as a structural member of the object.

While FIGS. 1-3 illustrate the antiballistic armor 100 having two layers of balls 204, the antiballistic armor 100 may have only one layer of balls 204 or may have more than two layers of balls 204. In one embodiment, the antiballistic armor 100 has three layers of balls 204.

The antiballistic armor 100 provides a variety of advantages over conventional armor. Firstly, the antiballistic armor 100 provides a level of protection against a range of armor-piercing projectiles from about five mm through about 30 mm, as well as from normal small caliber rounds (e.g., rounds that are about 13 mm caliber or smaller). Further, the antiballistic armor 100 is lightweight, having a weight of less than 44 $kg/m^2$ in one embodiment. In addition, the antiballistic armor 100 is capable of arresting multiple strikes within the same general area. Yet further, the antiballistic armor 100 is more cost effective to produce as compared to conventional armor. Further, the antiballistic armor 100 is capable of being used as vehicle structure, thus reducing the overall additional weight added to the vehicle by armor. The antiballistic armor 100 is also capable of withstanding debris encountered by the vehicle during normal combat operations, such as rocks, sand, shrapnel, and the like.

Figure 4:
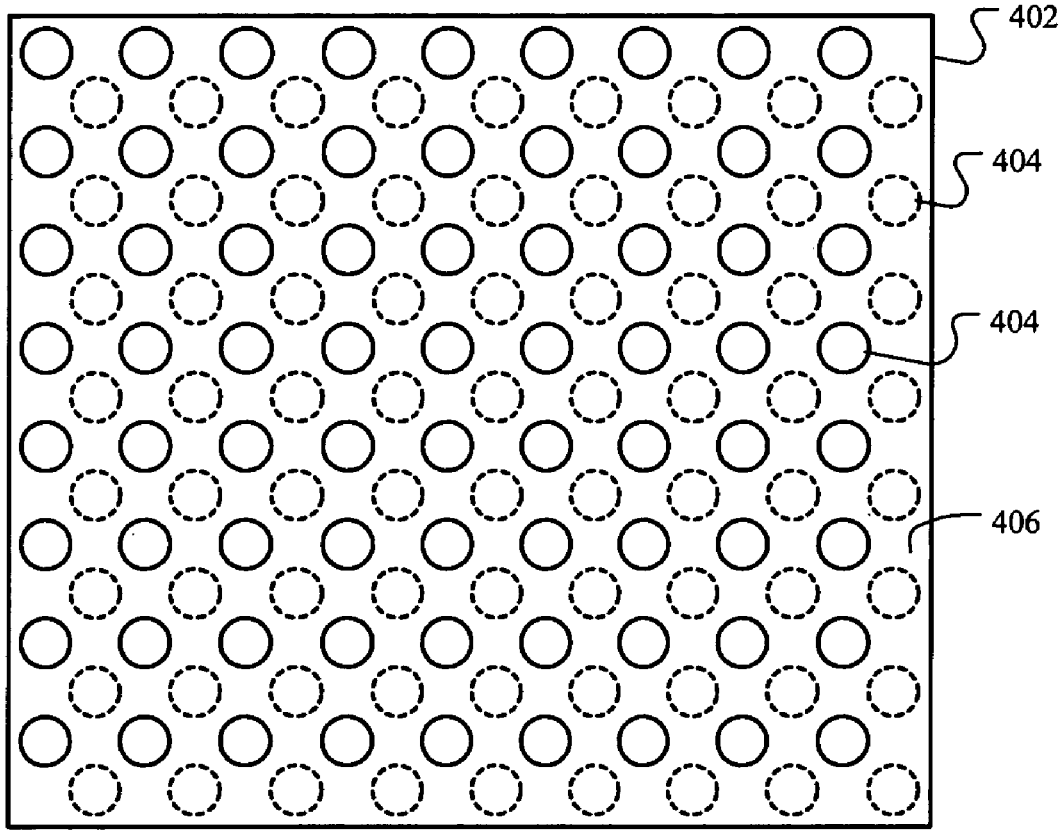
FIG. 4 is a top view of a core for the antiballistic armor of the present invention from the same vantage point as the view in FIG. 1.
Figure 5:
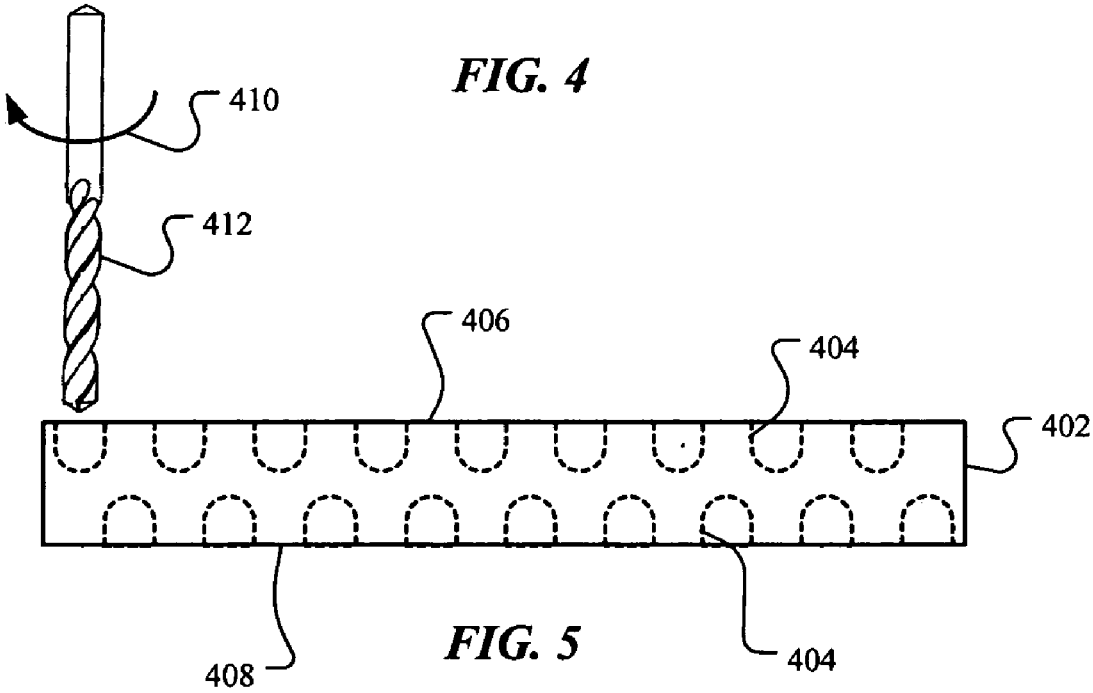
FIG. 5 is a side view of the core of FIG. 4.

FIGS. 4-9 illustrate a method of manufacturing the antiballistic armor 100 first shown in FIGS. 1-3. As shown in FIGS. 4 and 5, one or more portions of a core 402 are provided. If multiple portions of core 402 are used, they are arranged in a one- or two-dimensional array. Further, multiple layers of the core 402 may be laminated together and placed between the upper and lower face sheets (e.g., the upper face sheet 106 and the lower face sheet 212, or the like) to form, for example, a face sheet/core/core/face sheet structure. Pockets 404 are produced in the core 402 by drilling, boring, milling, or the like. In one embodiment, as described above and as shown in FIG. 4 and FIG. 5, the pockets 404 extending from a front surface 406 of the core 402 are staggered relative to the pockets 404 extending from a back surface 408 of the core 402.

Figure 6:
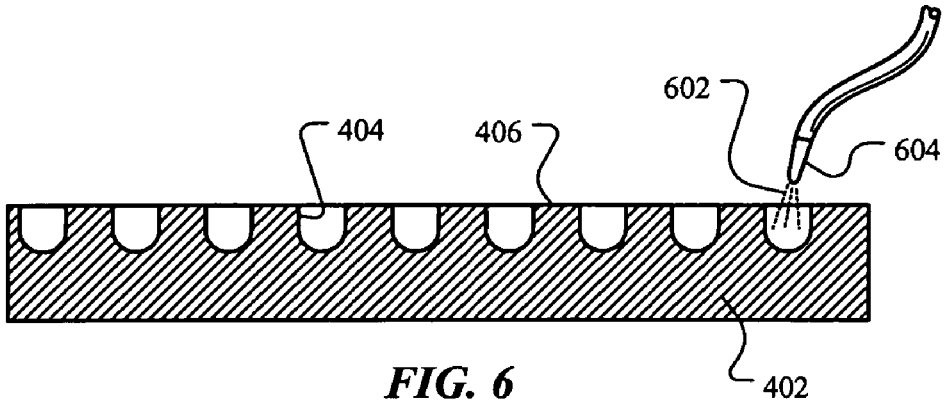
FIGS. 6-9 are cross sectional views taken along the line II-II of FIG. 1 at various stages during a method of manufacturing the antiballistic armor to illustrate a manufacturing method practiced in accordance with one embodiment of the present invention.
Figure 7:
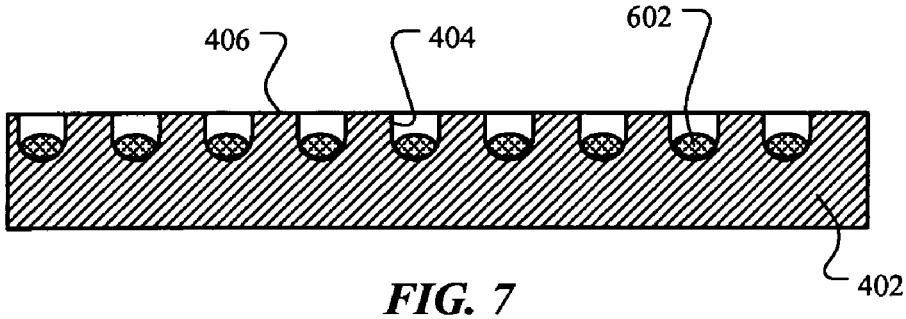

Referring now to FIG. 6, a bonding material 602 is applied within each of the pockets 404 extending from the front surface 406 of the core 402. As discussed above, the bonding material 602 may be an adhesive (e.g., an epoxy-based adhesive, a silicone-based adhesive, or the like), a brazing material (e.g., a brazing paste or the like), or a soldering material (e.g., a soldering paste or the like). While FIG. 6 illustrates the bonding material 602 being applied via a nozzle 604, any method of applying the bonding material 602 to the pockets 404 is within the scope of the present invention. FIG. 7 illustrates the core 402 with the bonding material 602 applied within each of the pockets 404 extending from the front surface 406 of the core 402.

Figure 8:
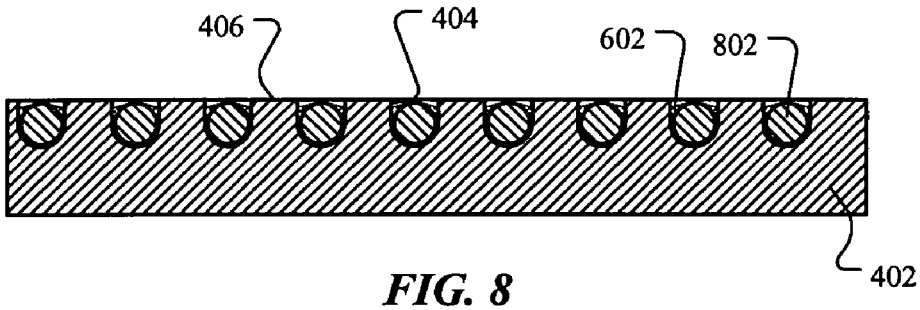

As illustrated in FIG. 8, balls 802 are then inserted into the pockets 404 extending from the front surface 406 of the core 402 such that the bonding material 602 surrounds at least a portion of the balls 802. As an alternative to applying the bonding material 602 within the pockets 404, each of the balls 802 may be coated with the bonding material 602 prior to being inserted into the pockets 404.

Figure 9:
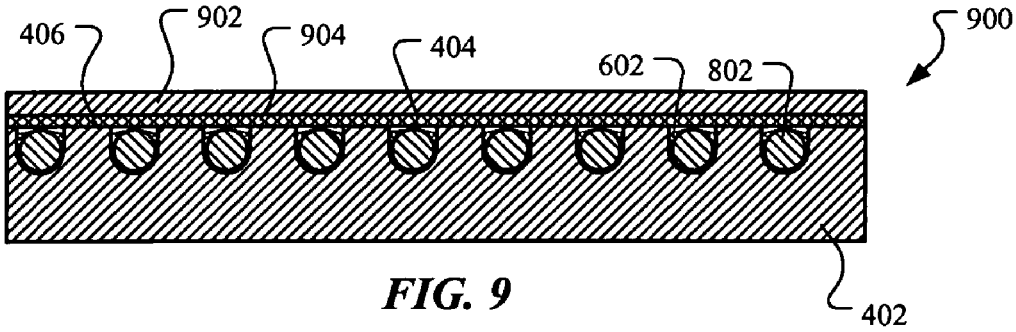

FIG. 9 illustrates the joining of an upper face sheet 902 to the front surface 406 of the core 402. A layer 904 of a bonding material is applied to the front surface 406 of the core 402 and/or to the upper face sheet 902. The core 402 and the upper face sheet 902 are then assembled.

The assembly 900 may now be turned over so that the back surface 408 of the core 402 may be accessed. The pockets 404, extending from the back surface 408 of the core 402 are produced and the bonding material 602 is applied within the pockets 404. The balls 802 are then inserted into the pockets 404 extending from the back surface 408 of the core 402. A lower face sheet (e.g., the lower face sheet 212 or the like) is then assembled to the back surface 408 of the core 402. These steps may be performed as described above and illustrated in FIGS. 4-9.

The present invention is not limited, however, to the method illustrated in FIGS. 4-9 and the corresponding description provided above. Rather, the antiballistic armor 100 may be manufactured by any method capable of producing the antiballistic armor 100. Further, the present invention is not limited to the procedures in the order provided above and illustrated in FIGS. 4-9. For example, all of the pockets 404 may be produced in the core 402 prior to any other procedure being performed. Further, depending upon the bonding material 602 used to bond the balls 802 within the pockets 404, a heating cycle may be required before the upper face sheet 902 and the lower face sheet (e.g., the lower face sheet 212 or the like) are assembled to the core 402 to set the bonding material 602. Another heating cycle may be required to set one or both of the layers 904, 216, 210 of bonding material. Setting these layers of bonding material means curing an adhesive or melting and solidifying a brazing or soldering material such that the elements in contact with the bonding material are bonded.

Accordingly, in one embodiment, the antiballistic armor 100 may be completely assembled before any heating cycle to activate any of the bonding materials. In another embodiment, one or more heating cycles may be desirable during the assembly of the antiballistic armor 100 to activate various bonding materials used in the assembly. Alternatively, depending upon the bonding materials used, no heating cycle may be used.

Further, in one embodiment, the pockets 404 are sized such that the balls 802 may be press-fit into the pockets 404. In such an embodiment, application of the bonding material 602 may be omitted from the method of the present invention.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. In particular, every range of values (of the form, "from about a to about b," or, equivalently, "from approximately a to b," or, equivalently, "from approximately a-b") disclosed herein is to be understood as referring to the power set (the set of all subsets) of the respective range of values, in the sense of Georg Cantor. Accordingly, the protection sought herein is as set forth in the claims below.

What is claimed is:

1. An antiballistic armor, comprising:

a foamed metallic core having a first surface, a second surface, and defining a plurality of pockets extending into the core;

a plurality of projectile impeding elements, wherein one of the projectile impeding elements is disposed within each of the pockets of the core;

a first face sheet joined to the first surface of the core; and a second face sheet joined to the second surface of the core.

2. An antiballistic armor, according to claim 1, wherein the core comprises a material selected from the group consisting of an iron alloy, nickel, a nickel alloy, aluminum, an aluminum alloy, titanium, and a titanium alloy.

3. An antiballistic armor, according to claim 1, wherein the core exhibits one of an open celled structure and a closed cell structure.

4. An antiballistic armor, according to claim 1, wherein the core exhibits a pore count within a range of about four pores per linear centimeter to about sixteen pores per linear centimeter.

5. An antiballistic armor, according to claim 1, wherein the core exhibits a generally continuously connected, reticulated geometry having a duodecahedronal cell shape.

6. An antiballistic armor, according to claim 1, wherein the plurality of pockets extends into the core from the first surface of the core.

7. An antiballistic armor, according to claim 6, wherein the core defines a second plurality of pockets extending into the core from the second surface of the core.

8. An antiballistic armor, according to claim 7, wherein the plurality of pockets extending into the core from the first surface are staggered from the second plurality of pockets extending into the core from the second surface of the core.

9. An antiballistic armor, according to claim 1, wherein the plurality of projectile impeding elements comprises balls made of a material selected from the group consisting of silicon nitride, silicon carbide, boron nitride, and aluminum oxide.

10. An antiballistic armor, according to claim 1, further comprising a bonding material, disposed within the pockets of the core, to attach the plurality of projectile impeding elements within the plurality of pockets of the core.

11. An antiballistic armor, according to claim 10, wherein the bonding material is selected from the group consisting of an adhesive, a brazing material, and a soldering material.

12. An antiballistic armor, according to claim 10, wherein the bonding material is selected from the group of an epoxy-based adhesive, a silicone-based adhesive, a brazing paste, and a soldering paste.

13. An antiballistic armor, according to claim 1, wherein the plurality of projectile impeding elements are held within the pockets of the core by friction between the plurality of projectile impeding elements and walls of the core defining the plurality of pockets of the core.

14. An antiballistic armor, according to claim 1, wherein the first face sheet is made of a metallic material.

15. An antiballistic armor, according to claim 1, wherein the first face sheet is made of a material selected from the group consisting of titanium and a titanium alloy.

16. An antiballistic armor, according to claim 1, wherein the second face sheet is made of a material selected from the group consisting of a metallic material and a composite laminate.

17. An antiballistic armor, according to claim 1, wherein the second face sheet is made from a material selected from the group consisting of titanium and a titanium alloy.

18. An antiballistic armor, according to claim 1, wherein the first face sheet is joined to the first surface of the core and the second face sheet is joined to the second surface of the core by a process selected from the group consisting of adhesive bonding, brazing, and soldering, diffusion bonding, and welding.

19. An antiballistic armor, according to claim 1, wherein the first face sheet is joined to the first surface of the core and the second face sheet is joined to the second surface of the core by a material selected from the group consisting of an epoxy-based adhesive, a silicone-based adhesive, a brazing paste, a brazing sheet, a soldering paste, and a soldering sheet.

20. An antiballistic armor, according to claim 1, wherein the antiballistic armor is capable of being used as a structural member in an object.

21. An antiballistic armor, according to claim 1, wherein the core further comprises a plurality of core portions.

22. An antiballistic armor, according to claim 1, wherein the core further comprises a plurality of laminated core portions.

* * * * *